US009488352B2

(12) United States Patent
Hussey et al.

(10) Patent No.: US 9,488,352 B2
(45) Date of Patent: Nov. 8, 2016

(54) RADIO FREQUENCY (RF) SIGNAL PATHWAY FOR A LAMP ANTENNA

(71) Applicants: Andrew C. Hussey, Stow, OH (US); Timothy Chen, Aurora, OH (US); Nicholas C. Purpera, North Olmsted, OH (US)

(72) Inventors: Andrew C. Hussey, Stow, OH (US); Timothy Chen, Aurora, OH (US); Nicholas C. Purpera, North Olmsted, OH (US)

(73) Assignee: TECHNICAL CONSUMER PRODUCTS, INC., Aurora, OH (US)

( * ) Notice: Subject to any disclaimer, the term of this patent is extended or adjusted under 35 U.S.C. 154(b) by 197 days.

(21) Appl. No.: 14/289,180

(22) Filed: May 28, 2014

(65) Prior Publication Data

US 2015/0345764 A1 Dec. 3, 2015

(51) Int. Cl.

| | |
|---|---|
| ***F21V 23/00*** | (2015.01) |
| ***H05B 33/00*** | (2006.01) |
| *F21Y 101/02* | (2006.01) |
| *F21K 99/00* | (2016.01) |
| *F21S 8/02* | (2006.01) |

(52) U.S. Cl.

CPC ..... *F21V 23/006* (2013.01); *H05B 33/00* (2013.01); *F21K 9/135* (2013.01); *F21S 8/02* (2013.01); *F21Y 2101/02* (2013.01)

(58) Field of Classification Search

CPC .... F21Y 2101/02; F21V 23/006; F21S 8/02; F21K 9/135; F21K 9/1355

See application file for complete search history.

(56) References Cited

U.S. PATENT DOCUMENTS

| | | | | |
|---|---|---|---|---|
| 7,699,494 | B2 | 4/2010 | Catalano et al. | |
| 7,959,332 | B2 | 6/2011 | Tickner et al. | |
| 2012/0224371 | A1* | 9/2012 | Hsueh | F21K 9/135 362/235 |
| 2012/0261173 | A1 | 10/2012 | Shen et al. | |
| 2013/0181607 | A1* | 7/2013 | Yotsumoto | H05B 37/00 315/70 |
| 2013/0223061 | A1* | 8/2013 | Hwu | F21K 9/135 362/235 |
| 2014/0021862 | A1 | 1/2014 | Chung | |
| 2014/0070703 | A1 | 3/2014 | Chen et al. | |
| 2014/0103824 | A1* | 4/2014 | Chen | H05B 33/0821 315/192 |
| 2014/0126220 | A1* | 5/2014 | Chen | F21K 9/1355 362/311.02 |
| 2015/0043212 | A1* | 2/2015 | Coffey | F21K 9/1355 362/294 |
| 2015/0103515 | A1* | 4/2015 | Bosua | H05B 37/0272 362/157 |
| 2015/0109781 | A1* | 4/2015 | Van Der Merwe | F21V 23/0435 362/249.01 |
| 2015/0211687 | A1* | 7/2015 | Chung | F21K 9/135 315/34 |
| 2015/0327349 | A1* | 11/2015 | Lee | H05B 37/0272 362/294 |

FOREIGN PATENT DOCUMENTS

| | | | |
|---|---|---|---|
| WO | WO2015/145297 | * 10/2015 | F21V 23/00 |

* cited by examiner

*Primary Examiner* — Peggy Neils

(74) *Attorney, Agent, or Firm* — Thompson Hine LLP

(57) ABSTRACT

An illumination device is disclosed, and includes a first housing defining an interior cavity and an aperture, at least one lighting element, and a driver board electrically coupled to the lighting element. The driver board includes an antenna element. The driver board is positioned at least in part within the interior cavity of the first housing. The aperture of the first housing is positioned so as to create a pathway such that radio frequency (RF) signals reach the interior cavity of the first housing.

19 Claims, 10 Drawing Sheets

RADIO FREQUENCY (RF) SIGNAL PATHWAY FOR A LAMP ANTENNA

TECHNICAL FIELD

The present disclosure relates generally to antenna elements for lamps, and more particularly to a lamp utilizing a housing defining an aperture, where the aperture is positioned to create a pathway such that radio frequency (RF) signals reach an interior cavity of the housing.

BACKGROUND

Wireless lighting control systems may utilize radio frequency (RF) communication to communicate control signals to an antenna element that is mounted on a driver board of a light fixture or bulb. For example, a user may turn on, turn off, or dim a light using wireless control. However, sometimes light fixtures include a housing that is constructed of a metallic material. The antenna element may be placed within or enclosed by the metallic housing. Thus, the metallic housing may act as an RF shield, which effectively blocks RF signals from reaching the antenna element. As a result, it may be difficult to wirelessly control the light, since the metallic housing significantly reduces the ability of RF signals to reach the antenna element.

In one attempt to improve RF reception within a lighting fixture, a three dimensional antenna such as, for example, a relatively small whip antenna may be soldered to the driver board of the lighting fixture. However, soldering the whip antenna to the driver board may substantially increase the labor and cost associated with the lighting fixture. Thus, there exists a continuing need in the art for a cost-effective antenna element that provides improved RF reception in an illumination device such as a light fixture or bulb.

SUMMARY

In one embodiment, an illumination device is disclosed. The illumination device includes a first housing defining an interior cavity and an aperture, at least one lighting element, and a driver board that is electrically coupled to the lighting element. The driver board includes an antenna element. The driver board is positioned at least in part within the interior cavity of the first housing. The aperture of the first housing is positioned so as to create a pathway such that radio frequency (RF) signals reach the interior cavity of the first housing.

In another embodiment, a lighting fixture is disclosed and includes a first housing, a second housing, at least one lighting element, and a driver board. The first housing has an open end and a closed end, where an aperture is defined along a wall of the closed end. The second housing defines a cavity and an opening. The opening of the second housing is seated against the wall of the first housing. The driver board is electrically coupled to the lighting element and includes an antenna element. The driver board is positioned at least in part within the cavity of the second housing. The aperture of the first housing is positioned so as to create a pathway such that radio frequency (RF) signals reach the interior cavity of the first housing.

DETAILED DESCRIPTION

Figure 1:
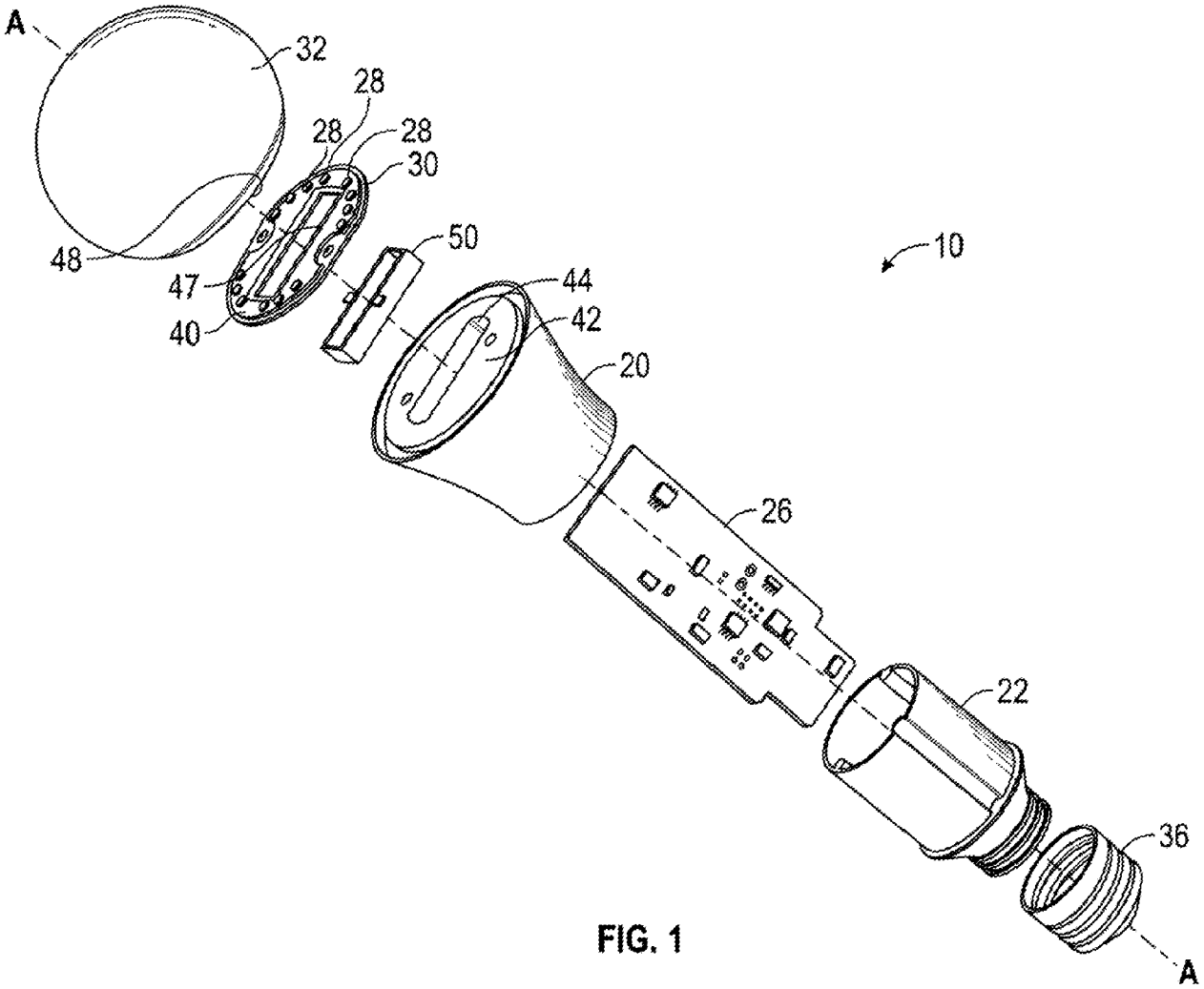
FIG. 1 is an exploded view of an exemplary lamp.

The following detailed description will illustrate the general principles of the invention, examples of which are additionally illustrated in the accompanying drawings. In the drawings, like reference numbers indicate identical or functionally similar elements.

Figure 2:
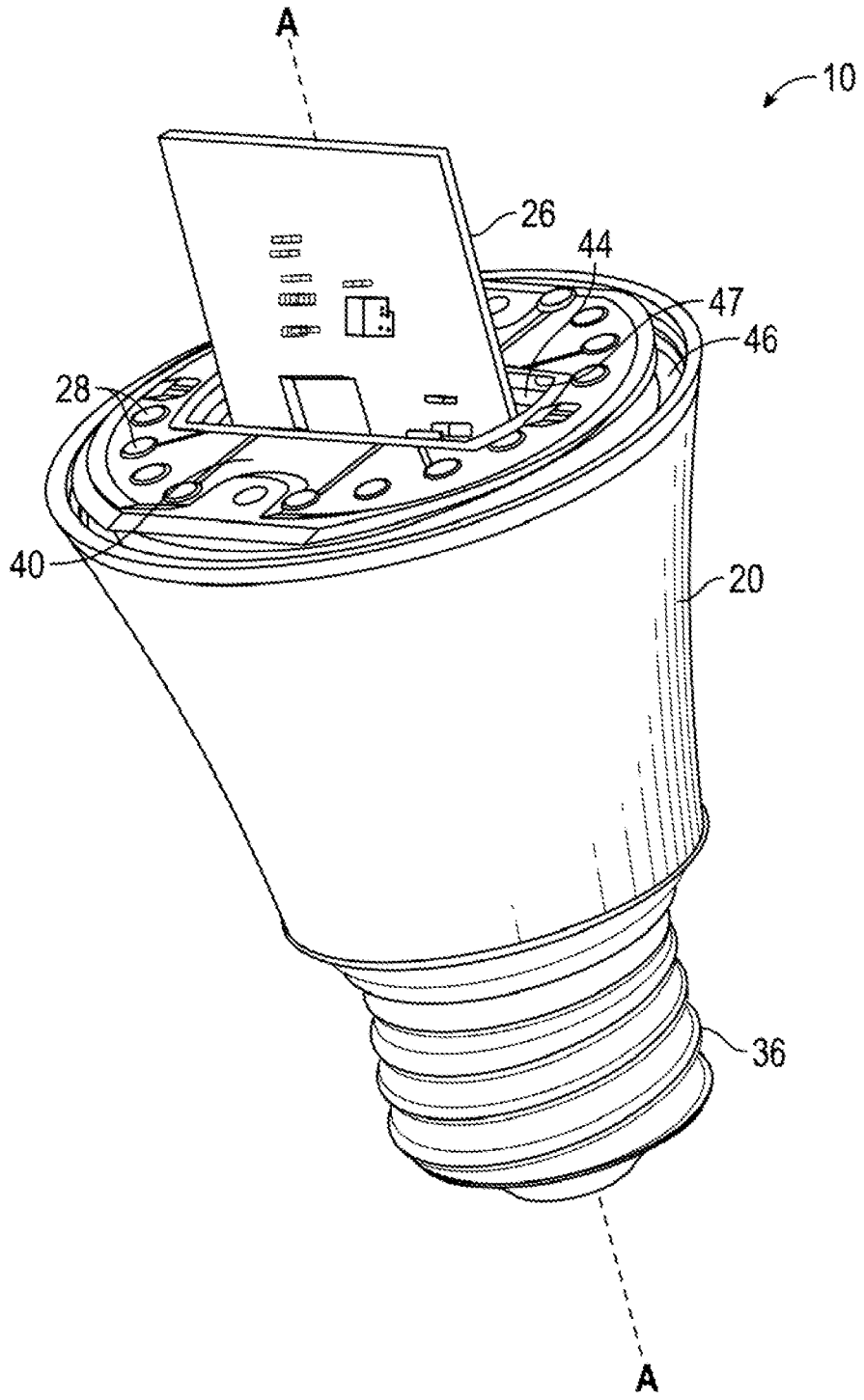
FIG. 2 is a perspective view of the lamp shown in FIG. 1.

FIGS. 1-2 illustrate an exemplary lamp 10. The lamp 10 may include a first housing 20, a sleeve or second housing 22, a driver board 26, a one or more lighting elements 28, a lighting element board 30, an optic element 32, and a socket base 36. In the embodiment as shown, the lighting elements 28 are disposed along an upper surface 40 of the lighting element board 30. The lighting elements 28 may be light emitting diodes (LEDs). Those skilled in the art will appreciate that although the lamp 10 is illustrated as a type A light bulb, the disclosure should not be limited to a specific type of lamp. Indeed, any type of illumination device that is configured to transmit visible light may be used as well such as, for example, a recessed downlight fixture. Moreover, although an LED bulb is illustrated, it is to be understood that the disclosure is not limited to LED lighting, and may be applied to other types of lighting as well such as, but not limited to, fluorescent tube lighting or a compact fluorescent lighting (CFL).

In one non-limiting embodiment, the first housing 20 may be constructed of a heat-conducting metal such as, for example, aluminium or a metal alloy. Alternatively, in another embodiment, the first housing 20 may be constructed of a thermally conductive plastic. One commercially available example of a thermally conductive plastic is sold under the trade name THERMA-TECH, and is available from the PolyOne Corporation of Avon Lake, Ohio. The second housing 22 may be constructed of any type material that is an electrical insulator that allows for radio frequency (RF) signals to pass through such as, but not limited to, plastic. For example, in one embodiment the second housing 22 may be constructed from acrylonitrile butadiene styrene (ABS).

Figure 3:
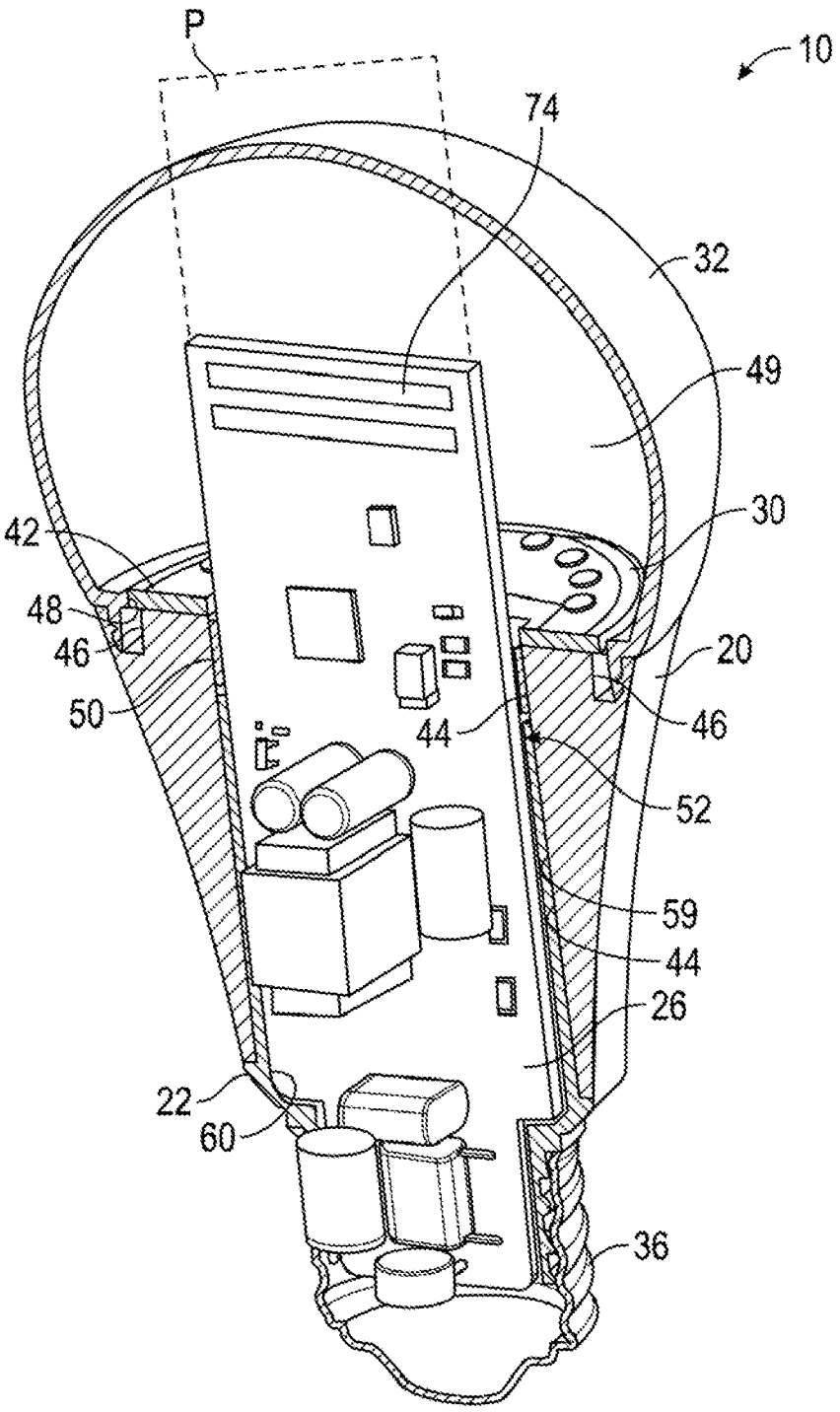
FIG. 3 is a cross-sectioned view of the lamp shown in FIG. 1.

Referring to FIGS. 1-3, the first housing 20 may include a centrally located aperture 44 and a recess 46 disposed along a top surface 42 of the first housing 42. Specifically, the aperture 44 may be located at a central axis A-A of the lamp 10. The lighting element board 30 may also include a centrally located aperture 47 that corresponds with the aperture 44 of the first housing 20. Referring specifically to FIG. 3, the recess 46 of the first housing 20 is shaped to receive an opening 48 of the optic element 32. Specifically, when the lamp 10 is assembled, the opening 48 of the optic element 32 may be seated within the recess 46 of the first housing 20.

The optic element 32 may be an enclosure that defines a lighting cavity 49. As seen in FIG. 3 the lighting elements 28 and the lighting element board 30 are enclosed and surrounded by the optic element 32 when the lamp 10 is assembled. The optic element 32 may be constructed of any substantially transparent or translucent material that allows for light to pass therethrough. For example, the optic element 32 may be constructed of a plastic such as polycarbonate. In an alternative embodiment, the optic element 32 may be constructed from glass.

Referring to both FIGS. 1 and 3, an insert ring 50 may be shaped to fit within the aperture 44 of the first housing 20. The insert ring 50 may be constructed of an electrical insulator such as, for example, plastic. The insert ring 50 may be placed within the aperture 44 of the first housing 20. As seen in FIG. 3, an upper end portion 52 of the driver board 26 may be received by the insert ring 50. In other words, the insert ring 50 may surround the upper end portion 52 of the driver board 26. The insert ring 50 may be used to provide electrical insulation between the driver board 26 and the first housing 20 (if the first housing 20 is constructed of metal) as well as the lighting element board 30.

Figure 4:
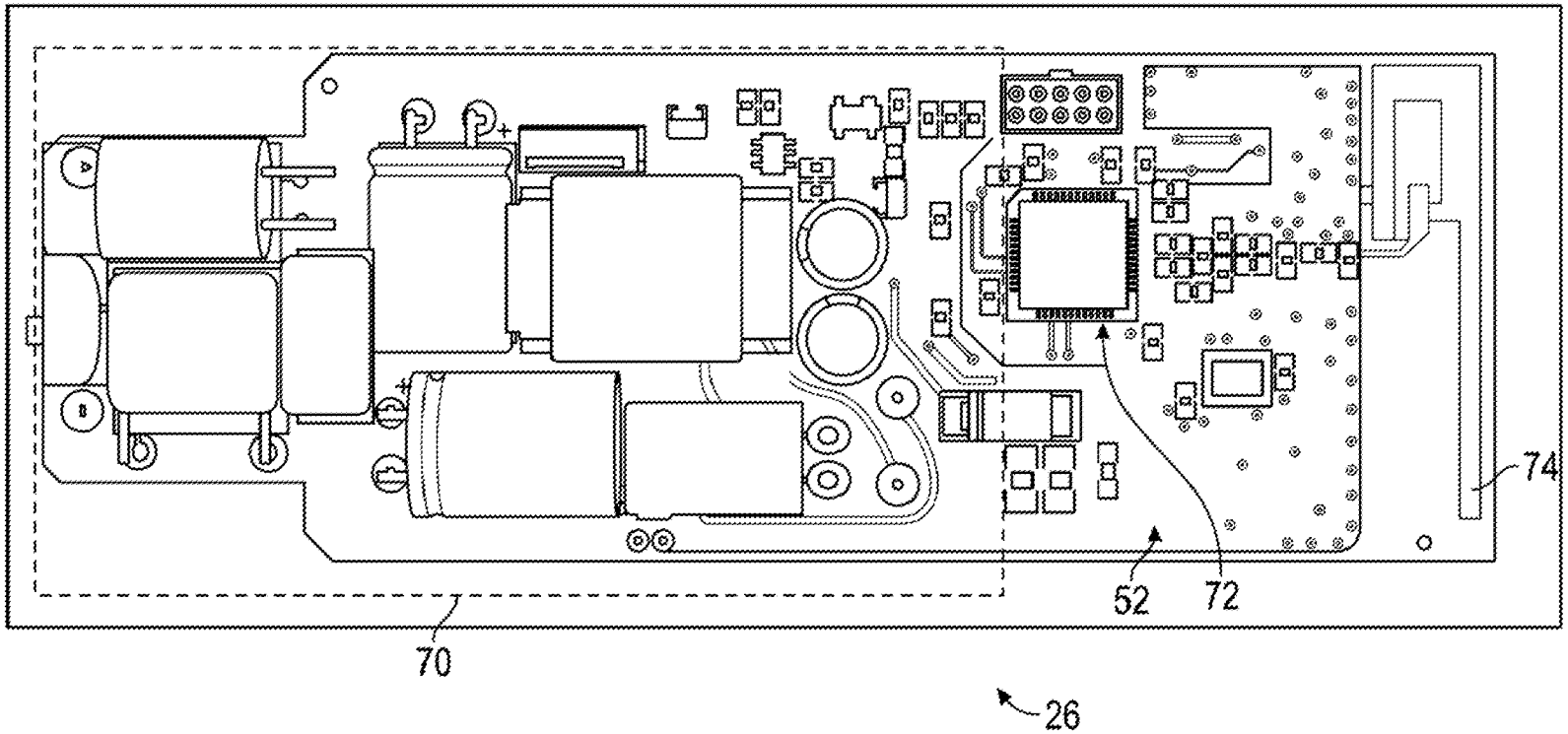
FIG. 4 is an illustration of a driver board of the lamp shown in FIG. 1.

FIG. 4 is an illustration of the driver board 26. The driver board 26 may include various power electronics 70, a microcontroller and radio 72, and an antenna element 74. In one embodiment, the driver board 26 may be a printed circuit board (PCB). In an embodiment, the antenna element 56 may be positioned along the upper end 52 of the driver board 26. Positioning the antenna element 56 along or proximate to the upper end 52 of the driver board 26 may decrease RF signal attenuation, and is explained in greater detail below. Although positioning the antenna element 74 along the upper end portion 52 of the driver board 26 is discussed, it is to be understood is not limited to this configuration, and that the antenna element 74 may be positioned anywhere along the driver board 26. The driver board 26 is electrically coupled and delivers power to the lighting elements 28 (shown in FIG. 3). In one embodiment, at least a portion of the driver board 26 may be coated with a white solder mask. In particular, referring to both FIGS. 3 and 4, the upper end 52 of the driver board 26 may project or extend out of the aperture 44 of the first housing 20, and extend into the lighting cavity 49. If the portion of the driver board 26 that is located within the lighting cavity 49 is coated with a white solder mask, this improves light transmission since the white solder mask reflects light.

Referring to FIG. 4, the driver board 26 is illustrated a PCB and the antenna element 74 is illustrated a trace antenna. However, those skilled in the art will appreciate that the disclosure is not limited to a trace antenna and PCB. In one embodiment, the antenna element 74 may be configured to receive a short-range RF signal such as, for example, a Bluetooth® signal conforming to IEEE Standard 802.15. Moreover, although only one antenna element 74 is discussed, those skilled in the art will readily appreciate that more than antenna element may also be included on the driver board 26 as well in order to receive RF signals of varying frequencies. Alternatively, in another embodiment, the antenna element 74 may be a multi-band antenna that operates at different RF frequency bands.

Referring to FIG. 3, the first housing 20 may define an internal cavity 59. The internal cavity of the first housing 59 may be configured to receive at least a portion of the second housing 22 as well as the driver board 26. The second housing 22 may also define a cavity 60 that is configured to receive the driver board 26. The driver board 26 is oriented within the cavity 60 of the second housing 22 such that RF signals may reach the antenna element 74 without substantial obstruction by an element that effectively block RF signals. Specifically, in the embodiment as shown in FIG. 3, the driver board 26 projects outwardly from the aperture 44 of the first housing 20 such that the antenna element 74 is positioned within the lighting cavity 49. However, while FIG. 3 illustrates the antenna element 74 located within the lighting cavity 49, it is to be understood that in some embodiments the antenna element 74 may be positioned along the driver board 26 such that the antenna element 26 is located within the second housing 20. However, those skilled in the art will readily appreciate that if the first housing 20 is contracted of a material that effectively blocks RF signals (e.g., aluminium), then placing the antenna element 74 within the lighting cavity 49 may decrease antenna attenuation.

Continuing to refer to FIG. 3, in one embodiment a vertical plane P of the driver board 26 is substantially aligned with the aperture 44 of the first housing 20. Thus, the aperture 44 of the first housing 20 creates a pathway for RF signals to travel into the interior cavity 59 of the first housing 20. Therefore, in the event the first housing 20 is constructed from a material that effectively blocks RF signals, it is still possible for RF signals to reach the antenna element 74, even if the antenna element 74 is located within the internal cavity 59 of the first housing 20.

Figure 5:
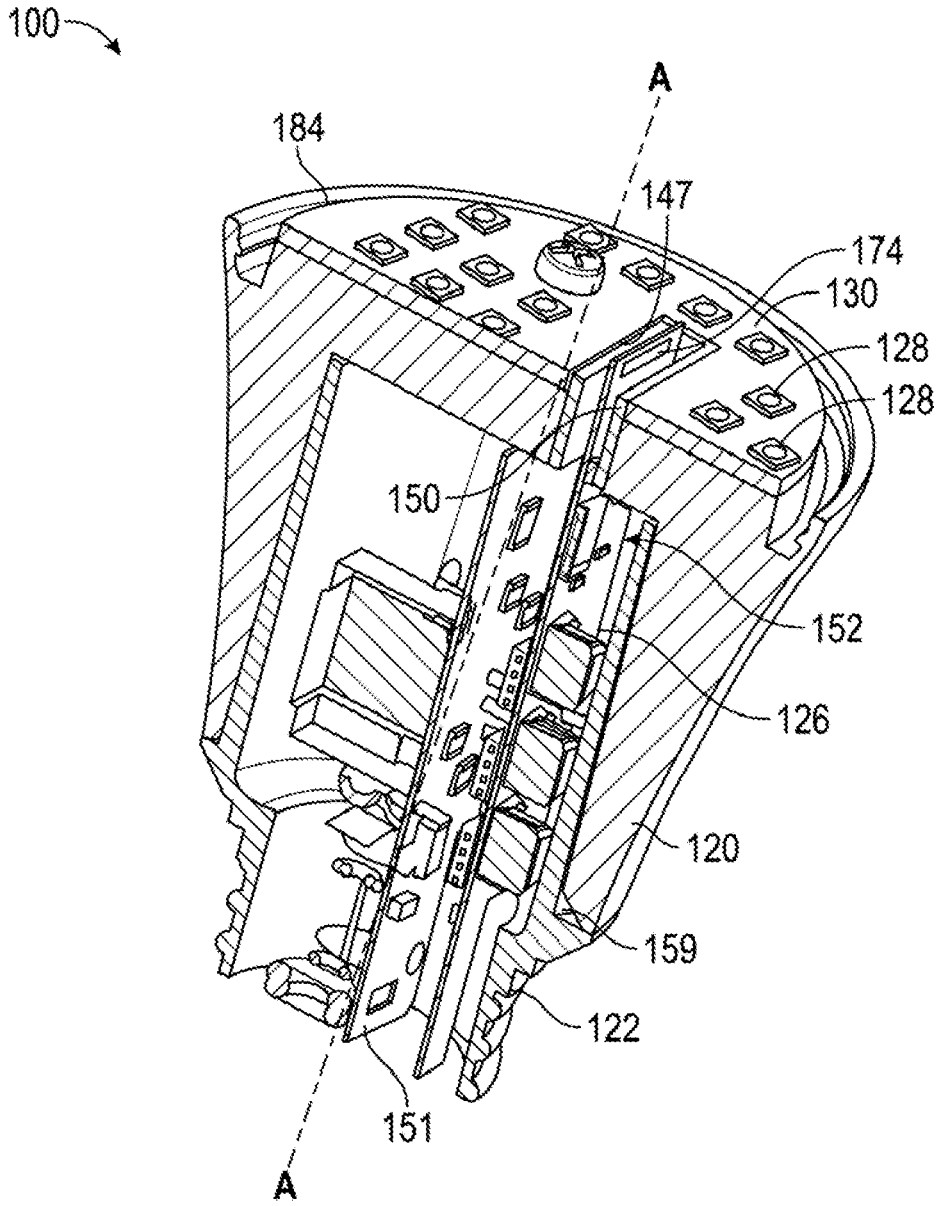
FIG. 5 is a cross-sectioned view of an alternative embodiment of a lamp.

FIG. 5 is an alternative embodiment of a lamp 100. Similar to the embodiment as shown in FIGS. 1-4 and described above, the lamp 100 may include a first housing 120, a sleeve or second housing 122, a first driver board 126, a one or more lighting elements 128, a lighting element board 130, an optic element (not illustrated), and an insert ring 150. Additionally, the lamp 100 may also include a second driver board 151 that is offset in a generally horizontal direction from the first driver board 126. The second driver board 151 may be used in the event that all of the electronics (e.g., the power electronics 70, microcontroller and radio 72, and the antenna element 74 as seen in FIG. 4) may not be able to fit on a single driver board. Sometimes the lamp 100 may not be able to accommodate a relatively large driver board due to packaging constraints. Therefore, two driver boards may be used instead to accommodate all of the electronics associated with powering the lighting elements 128.

Similar to the embodiment as described above and shown in FIGS. 1-4, an antenna element 174 may be disposed along an upper end portion 152 of the driver board 126. Specifically, the antenna element 174 projects outwardly from the aperture 144 of the first housing 20. Although FIG. 5 illustrates the antenna element 174 positioned along the upper end portion 152 of the driver board 126, it is to be understood that the antenna element 174 may be positioned anywhere along the driver board 126. Moreover, it is also understood that the antenna element 174 may also be positioned along the second driver board 151 as well.

As seen in FIG. 5, the second driver board 151 may be substantially enclosed within an interior cavity 159 of the first housing 120. However, the aperture 144 of the first housing 120 creates a pathway for RF signals to travel into the interior cavity 159 of the first housing 120. Therefore, in the event the first housing 120 is constructed from a material that effectively blocks RF signals, it is still possible for RF signals to reach the antenna element 174, even if the antenna element 174 is located along the second driver board 151.

Figure 6:
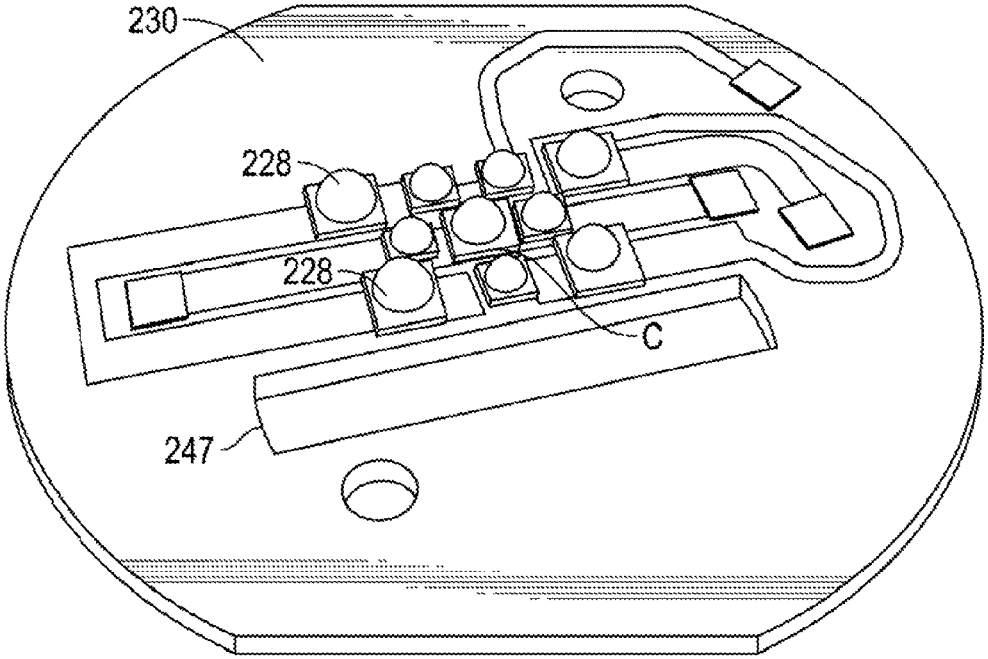
FIG. 6 is an alternative embodiment of a lighting element board for use in the lamp shown in FIG. 5.

In the embodiment as shown in FIG. 5, the lamp 100 may include an offset design. Specifically, unlike the embodiment as shown in FIG. 2, the aperture 144 of the first housing 120 as well as an aperture 147 of the lighting element board 130 may both be offset from the central axis A-A of the lamp 100. Therefore, the upper end portion 152 of the driver board 126 may also be offset from the central axis A-A of the lamp 100. In the embodiment as shown in FIG. 5, the lighting elements 128 may be disposed along an outer periphery 184 of the lighting element board 130. FIG. 6 is an alternative embodiment the lighting element board 230. Similar to the embodiment as shown in FIG. 5, the lighting board 230 may include an aperture 247 that is offset from the central axis A-A. However, the lighting element board 230 may also include a plurality of lighting elements 228 that are grouped at or around a center C of the lighting element board 230. Positioning the lighting elements 228 around the center C of the lighting element board 228 may be beneficial. Specifically, for example, placing the lighting elements 228 around the center C may provide enhanced light output and color temperature mixing.

Figure 7:
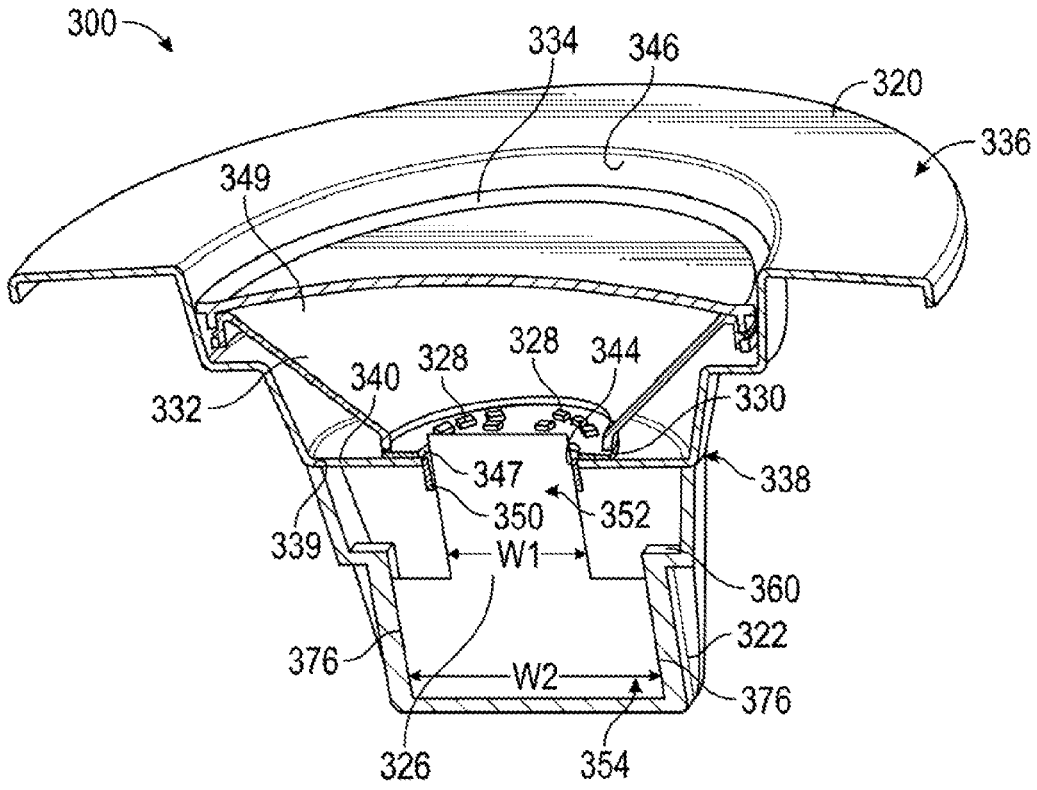
FIG. 7 is a cross-sectioned view of an exemplary downlight fixture.

FIG. 7 illustrates an exemplary downlight fixture 300. The downlight fixture 300 may include a first housing 320, a second housing 322, a driver board 326, one or more lighting elements 328, a lighting element board 330, an optic element 332, and a cover 334. Similar to the embodiments as described above and shown in FIGS. 1-6, the first housing 320 may be constructed of a heat-conducting metal or a thermally conductive plastic. The second housing 322 may be constructed of any type material that is an electrical insulator that allows for RF signals to pass through such as, but not limited to, plastic. The first housing 320 is positioned over the second housing 322. When the downlight fixture 300 is installed in a ceiling (not illustrated), the first housing 320 is typically exposed, and the second housing 322 is recessed within the ceiling.

The first housing 320 may include a open upper end 336 and a closed lower end 338. A wall 340 may be located at the lower end 338 of the first housing 320. An opening 339 of the second housing 322 may be seated against the wall 340 of the first housing 320. A centrally located aperture 344 may be disposed along the wall 340 of the first housing 320. The lighting element board 330 may also include a centrally located aperture 347 that corresponds with the aperture 344 of the first housing 320. The optic element 332 as well as the cover 334 may both be secured to the first housing 320. Specifically, the optic element 332 may be seated within a recess 346 of the first housing 320. The optic element 332 and the cover 334 may cooperate together to create an enclosure that defines a lighting cavity 349.

The downlight fixture 300 may also include an insert ring 350 shaped to fit within the aperture 344 of the first housing 320. An upper end portion 352 of the driver board 326 may be received by the insert ring 350. Similar to the embodiments as described above and shown in FIGS. 1-6, the insert ring 350 may be used to provide electrical insulation between the driver board 326 and the first housing 320 (if the first housing 320 is constructed of metal) as well as the lighting element board 330.

Figure 8:
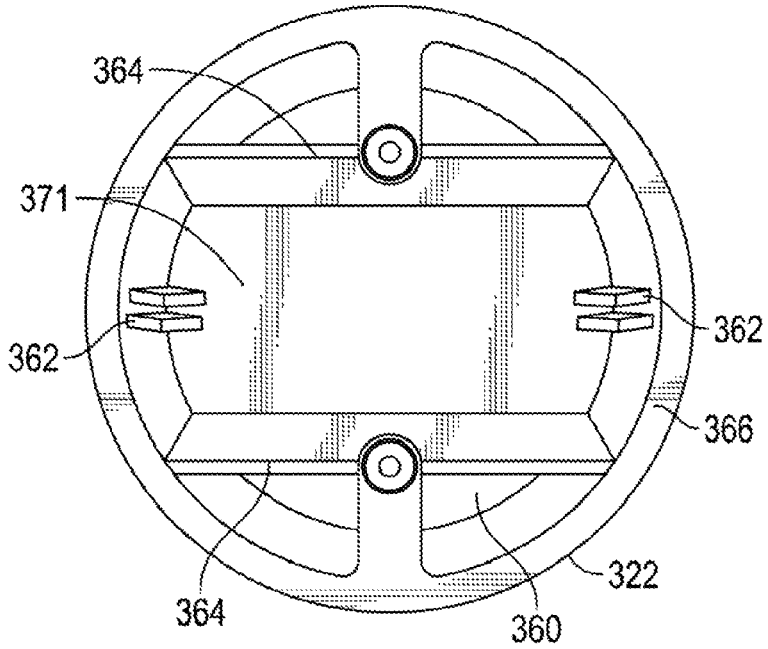
FIG. 8 illustrates an interior of a second housing of the downlight fixture shown in FIG. 7.

The driver board 326 may include the upper end portion 352 and a lower end portion 354. In the embodiment as shown, the upper end portion 352 include a first width W1 and the lower end portion 354 includes a second width W2. The first width W1 is less than the second width W2 such that the driver board 326 may have a generally T-shaped profile. The second width W2 of the driver board 326 may be sized so as to correspond with one or more positioning features (shown in FIG. 8 as a two opposing slots 362) located within a cavity 360 of the second housing 322. FIG. 8 illustrates the cavity 360 of the second housing 322. As seen in FIG. 8, the cavity 360 may include two opposing slots 362 located on opposing sides of the cavity 360. The two opposing slots 362 may be locating features that are used to position the driver board 326 (not shown in FIG. 8) in place within the cavity 360 of the second housing 322. The cavity 360 also includes two generally opposing walls 364 that cooperate with an outer wall 366 of the second housing 322 to create a potting chamber 371.

Referring to both FIGS. 7 and 8, the second width W2 of the driver board 322 may be sized such that the two opposing slots 362 may slidingly receive a side 376 of the driver board 326. Once the driver board 326 is placed within the two opposing slots 362, a potting material (not shown) may be placed within the potting chamber 371 to secure the driver board 326 in place within the cavity 360 of the second housing 322.

Figure 9:
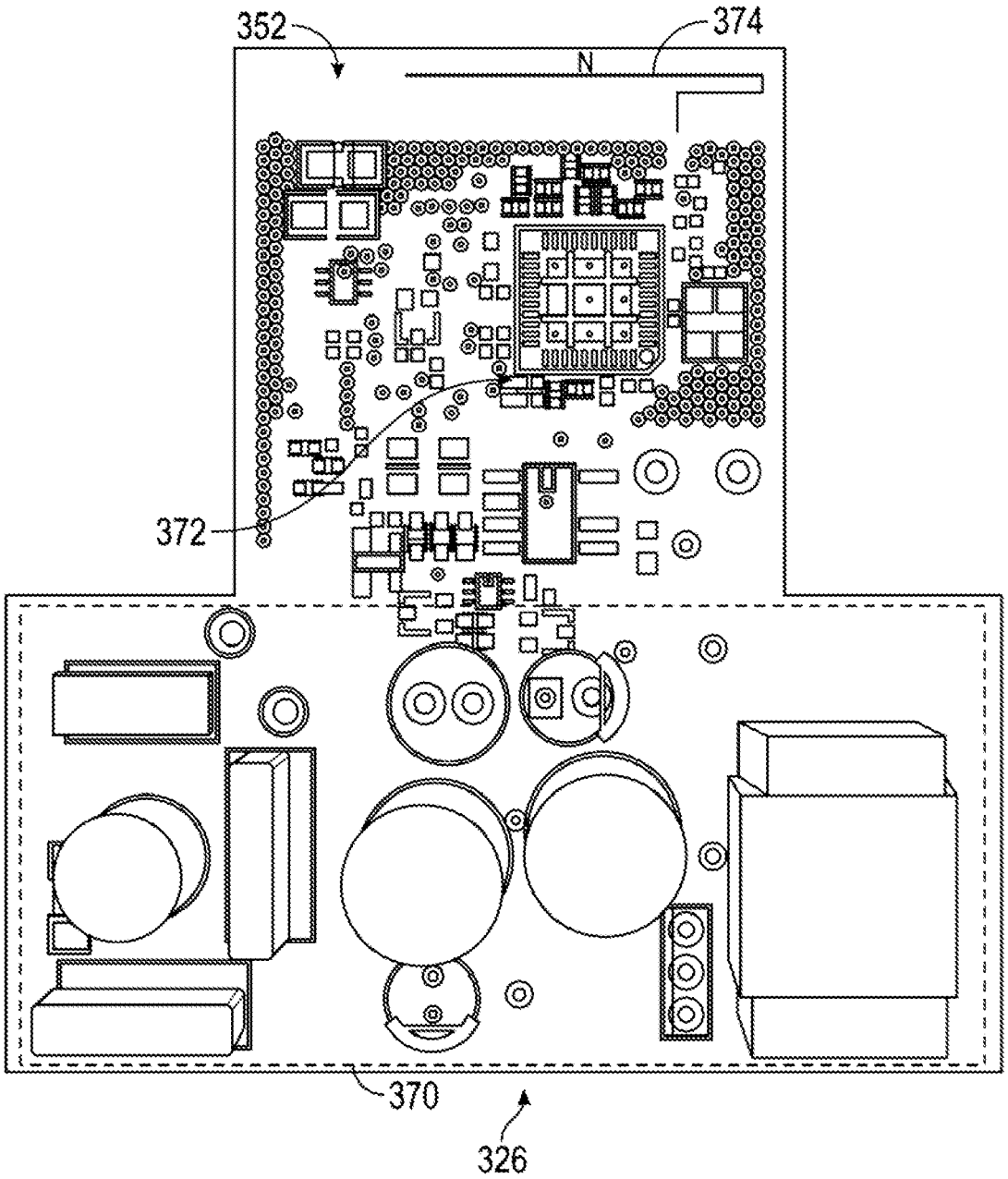
FIG. 9 is an illustration of a driver board of the downlight fixture shown in FIG. 7.

FIG. 9 is an illustration of the driver board 326. The driver board 326 may include various power electronics 370, a microcontroller and radio 372, and an antenna element 374. In an embodiment, the antenna element 356 may be positioned along the upper end portion 352 of the driver board 326. However, similar to the embodiments as described above, it is to be understood that the antenna element 374 may be positioned anywhere along the driver board 326. Referring to FIGS. 7 and 9, the driver board 326 projects outwardly from the aperture 344 of the first housing 320 such that the antenna element 374 is positioned within the lighting cavity 349. Similar to the embodiments as described above, the aperture 344 of the first housing 320 creates a pathway for RF signals to travel into the interior cavity 360 of the second housing 322. Therefore, in the event the first housing 320 is constructed from a material that effectively blocks RF signals, it is still possible for RF signals to reach the antenna element 374, even if the antenna element 374 is located within the cavity 360 of the second housing 322.

Figure 10:
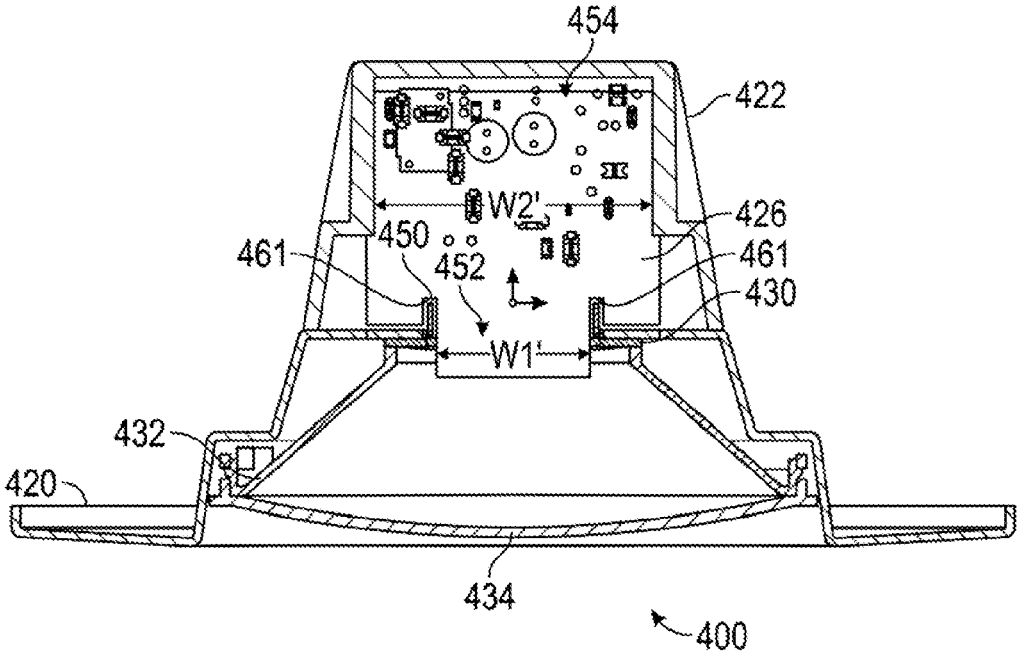
FIG. 10 is a cross-sectioned view of an alternative embodiment of a downlight fixture.
Figure 11:
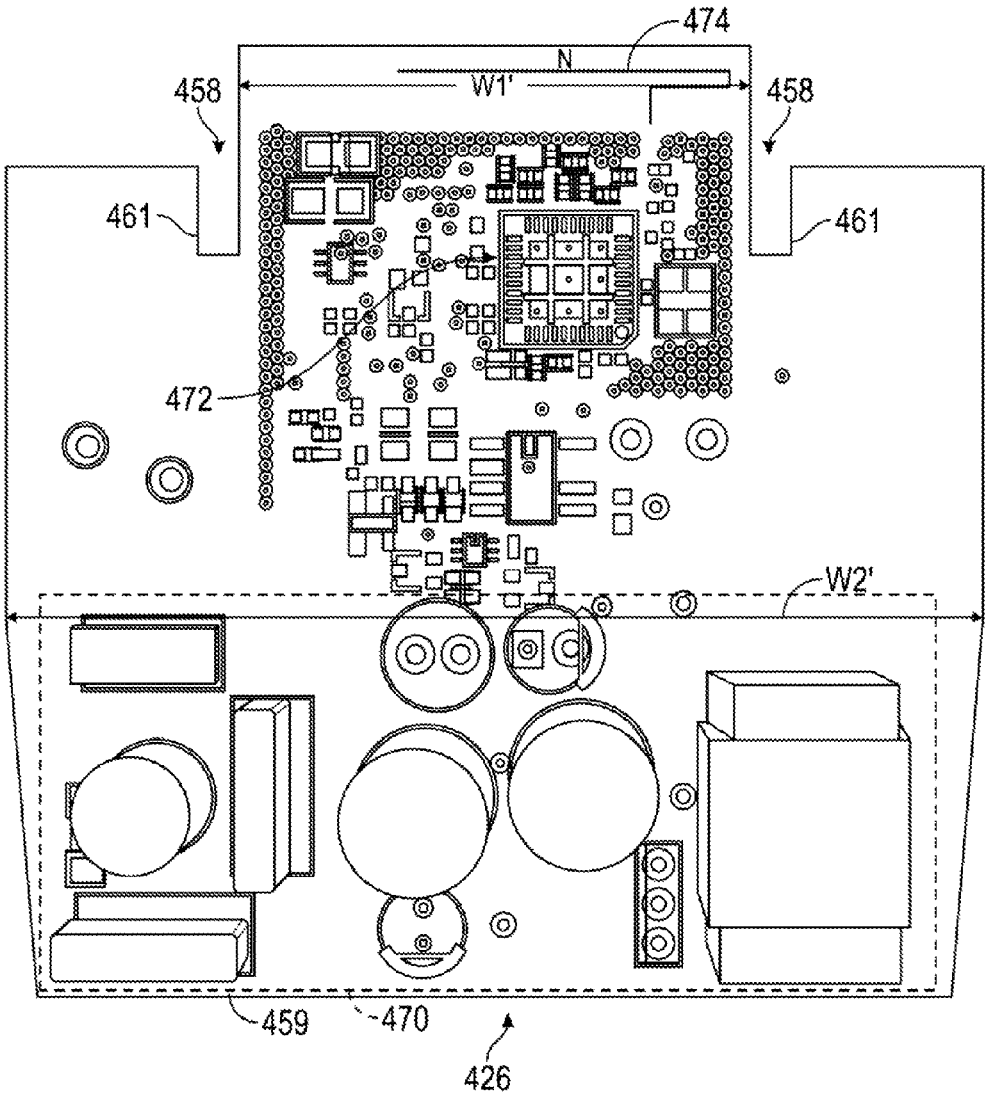
FIG. 11 is an illustration of a driver board of the downlight fixture shown in FIG. 10.

FIG. 10 is an alternative embodiment of a downlight fixture 400. The downlight fixture 400 may include a first housing 420, a second housing 422, a driver board 426, one or more lighting elements (not visible in FIG. 10), a lighting element board 430, an optic element 432, a cover 434, and an insert 450. Similar to the embodiment as shown in FIG. 10, the driver board 426 includes an upper end portion 452 and a lower end portion 454, where the upper end portion 452 includes a first width 'W1 and the lower end portion 454 includes a second width 'W2. The first width 'W1 is less than the second width 'W2. As seen in FIG. 11, the lower end portion 454 of the driver board 426 may include a tapered configuration.

Referring to FIG. 11, similar to the embodiments as described above, the driver board 426 may include various power electronics 470, a microcontroller and radio 472, and an antenna element 474. The driver board 426 may also include two shoulder areas 458 located along outer perimeter 459 of the driver board 426. The shoulder areas 458 represent where the first width 'W1 transitions into the second width 'W2. In the embodiment as shown, the first width 'W1 transitions into the second width 'W2 using a stepped configuration, which creates the two shoulder areas 458. A notch 461 may be located along each shoulder area 458 of the driver board 426. Referring to both FIGS. 10-11, the notches 461 may be shaped to receive a portion of the insert 450. The notches 462 may be used to secure driver board 426 in place within the second housing 422.

Referring generally to the figures, the disclosed lamps and lighting fixtures may include improved RF reception when compared to some types of illumination devices currently available. This is because the first housing, which may be a heat sink, includes an aperture that creates a pathway for RF signals to travel into an interior cavity of the first housing. Therefore, in the event the first housing is constructed from a material that effectively blocks RF signals such as, for example, aluminum it is still possible for RF signals to reach the antenna element. This is true even if the antenna element is buried or encased within the first housing.

While the forms of apparatus and methods herein described constitute preferred embodiments of this invention, it is to be understood that the invention is not limited to these precise forms of apparatus and methods, and the changes may be made therein without departing from the scope of the invention.

What is claimed is:

1. An illumination device, comprising:

a first housing defining an interior cavity and an aperture along a top surface of the first housing;

at least one lighting element; and a driver board electrically coupled to the at least one lighting element and including an antenna element disposed along a surface of the driver board, wherein the driver board is positioned at least in part within the interior cavity of the first housing and the antenna element is located within the interior cavity of the first housing, and wherein the aperture of the first housing is positioned so as to create a pathway such that radio frequency (RF) signals reach the interior cavity of the first housing and are received by the antenna element without obstruction by an element that effectively blocks RF signals.

2. The illumination device of claim 1, wherein the driver board includes an upper end portion those projects through the aperture of the first housing.

3. The illumination device of claim 1, further comprising an optic element that is an enclosure that defines a lighting cavity, and wherein the lighting cavity contains the at least one lighting element.

4. The illumination device of claim 3, wherein a portion of the driver board projects into the lighting cavity and is coated with a white solder mask.

5. The illumination device of claim 1, wherein the aperture of the housing is located along a central axis of the illumination device.

6. The illumination device of claim 1, wherein the aperture of the housing is located at a position that is offset from a central axis of the illumination device.

7. The illumination device of claim 1, further comprising a second driver board that is positioned at least in part within the interior cavity of the housing.

8. The illumination device of claim 1, further comprising a lighting element board, wherein the at least one lighting element is positioned along the lighting element board.

9. The illumination device of claim 8, wherein the lighting element board defines a second aperture that corresponds with the aperture in the first housing.

10. The illumination device of claim 1, further comprising a second housing, wherein the first interior cavity of the first housing is configured to receive at least a portion of the second housing and the driver board.

11. The illumination device of claim 1, further comprising an insert ring that is constructed of an electrical insulator, and wherein the insert ring is shaped to fit within the aperture of the first housing.

12. A lighting fixture, comprising:

a first housing having an open end and a closed end, wherein an aperture is defined along a wall of the closed end;

a second housing defining a cavity and an opening, wherein the opening of the second housing is seated against the wall of the first housing;

at least one lighting element; and a driver board electrically coupled to the at least one lighting element and including an antenna element disposed along a surface of the driver board, wherein the driver board is positioned at least in part within the cavity of the second housing and the antenna element is located within the cavity of the second housing, and wherein the aperture of the first housing is positioned so as to create a pathway such that radio frequency (RF) signals reach the cavity of the second housing and are received by the antenna element without obstruction by an element that effectively blocks RF signals.

13. The lighting fixture of claim 12, wherein the driver board includes an upper end portion and a lower end portion, wherein the upper end portion includes a first width and the lower end portion includes a second width.

14. The lighting fixture of claim 13, wherein the first width is less than the second width.

15. The lighting fixture of claim 14, further comprising an insert ring that is constructed of an electrical insulator, and wherein the insert ring is shaped to fit within the aperture of the first housing.

16. The lighting fixture of claim 15, wherein the first width of the driver board transitions into the second width of the driver board using a stepped configuration which creates the two shoulder areas around an outer periphery of the driver board.

17. The lighting fixture of claim 16, wherein a notch is located along each shoulder area of the driver board, and wherein each notch is shaped to receive a portion of the insert ring.

18. The lighting fixture of claim 12, wherein the driver board includes an upper end portion those projects through the aperture of the first housing, and wherein the antenna element is positioned at the upper end portion of the driver board.

19. A lighting fixture, comprising:

a first housing having an open end and a closed end, wherein an aperture is defined along a wall of the closed end;

a second housing defining a cavity and an opening, wherein the opening of the second housing is seated against the wall of the first housing;

at least one lighting element; and a driver board electrically coupled to the at least one lighting element and including an antenna element, wherein the driver board is positioned at least in part within the cavity of the second housing, and wherein the aperture of the first housing is positioned so as to create a pathway such that radio frequency (RF) signals reach the interior cavity of the first housing, the driver board comprising:

an upper end portion and a lower end portion, wherein the upper end portion includes a first width and the lower end portion includes a second width, the first width is less than the second width, wherein the first width of the driver board transitions into the second width of the driver board using a stepped configuration which creates the two shoulder areas around an outer periphery of the driver board, and wherein a notch is located along each shoulder area of the driver board; and an insert ring that is constructed of an electrical insulator, wherein the insert ring is shaped to fit within the aperture of the first housing, and wherein each notch of the driver board is shaped to receive a portion of the insert ring.

* * * * *